US009251681B2

(12) United States Patent
Takahashi et al.

(10) Patent No.: US 9,251,681 B2
(45) Date of Patent: Feb. 2, 2016

(54) FIRE ALARM SYSTEM

(71) Applicant: NOHMI BOSAI LTD., Chiyoda-ku, Tokyo (JP)

(72) Inventors: Masaki Takahashi, Tokyo (JP); Katsuhide Tsubokawa, Tokyo (JP)

(73) Assignee: NOHMI BOSAI LTD., Tokyo (JP)

( * ) Notice: Subject to any disclaimer, the term of this patent is extended or adjusted under 35 U.S.C. 154(b) by 89 days.

(21) Appl. No.: 13/935,887

(22) Filed: Jul. 5, 2013

(65) Prior Publication Data

US 2014/0009280 A1 Jan. 9, 2014

(30) Foreign Application Priority Data

Jul. 5, 2012 (JP) ..... 2012-151519

(51) Int. Cl.

*G08B 17/10* (2006.01)
*G08B 17/00* (2006.01)
*G08B 26/00* (2006.01)

(52) U.S. Cl.

CPC ..... *G08B 17/00* (2013.01); *G08B 26/003* (2013.01); *G08B 26/008* (2013.01)

(58) Field of Classification Search

None

See application file for complete search history.

(56) References Cited

U.S. PATENT DOCUMENTS

| | | | | |
|---|---|---|---|---|
| 2005/0035850 | A1* | 2/2005 | Schwager et al. | 340/310.01 |
| 2005/0169056 | A1* | 8/2005 | Berkman et al. | 365/185.22 |
| 2006/0132299 | A1* | 6/2006 | Mansfield et al. | 340/538 |
| 2007/0131786 | A1* | 6/2007 | Rossi et al. | 236/51 |
| 2007/0146128 | A1* | 6/2007 | Pumpelly et al. | 340/538 |
| 2008/0223850 | A1* | 9/2008 | Nakao | 219/618 |
| 2009/0072962 | A1* | 3/2009 | Hitchin | 340/524 |
| 2010/0308851 | A1* | 12/2010 | Schwager et al. | 324/750.02 |
| 2011/0291843 | A1* | 12/2011 | Andersen | 340/584 |

FOREIGN PATENT DOCUMENTS

| | | |
|---|---|---|
| CN | 2420697 | 2/2001 |
| JP | 2002-288751 | 10/2002 |

OTHER PUBLICATIONS

Communication dated Jul. 2, 2015 from the SIPO in a counterpart Chinese application No. 201310279282.9.

* cited by examiner

*Primary Examiner* — Ojiako Nwugo

(74) *Attorney, Agent, or Firm* — Wenderoth, Lind & Ponack, L.L.P.

(57) ABSTRACT

Provided is a fire alarm system including: a transmitter/receiver unit (4) for supplying a pulse voltage to power/signal lines (SG); a current value setting unit (5) for setting, as a current limiting value, an upper limit of a current output to the power/signal lines (SG) from the transmitter/receiver unit (4) when the pulse voltage is output; and a current control unit (6) for controlling the transmitter/receiver unit (4) to output a current having a value equal to or smaller than the current limiting value set by the current value setting unit (5). Accordingly, it is possible to prevent a malfunction from occurring in communications irrespective of a scale of the fire alarm system.

4 Claims, 6 Drawing Sheets

FIRE ALARM SYSTEM

BACKGROUND OF THE INVENTION

1. Field of the Invention

The present invention relates to a fire alarm system including a plurality of terminal devices and a fire control panel connected to the plurality of terminal devices via power/signal lines.

2. Description of the Related Art

There is a fire alarm system in which a plurality of terminal devices such as fire detectors are connected to a fire control panel via a pair of power/signal lines. In this fire alarm system, a pulse voltage (pulse signal) is supplied from the fire control panel to the terminal devices, and each of the terminal devices responds to the voltage supplied from the fire control panel. With unique addresses assigned to the plurality of terminal devices, the fire control panel calls the terminal devices in order based on the addresses. Then, the fire control panel receives information returned from the called terminal devices to collect information such as determination of fire and statuses of the terminal devices (see, for example, Japanese Patent Application Laid-open No. 2002-288751).

The terminal device includes a constant voltage circuit, and returns a signal to the fire control panel in combination with the pulse voltage (referred to as "L voltage" when the voltage is lowered) for lowering a voltage of the pair of power/signal lines to a predetermined voltage by turning on/off the constant voltage circuit. At this time, a transmission current is caused to flow through the power/signal lines, and a line voltage of (transmission current)×(line resistance) occurs due to the transmission current and a line resistance of the power/signal lines.

The pulse voltage returned by the terminal device becomes (predetermined voltage)+(line voltage), and is received by the fire alarm system. This leads to a problem in that the fire alarm system fails to discriminate the pulse voltage returned by the terminal device when the line voltage becomes higher. In order to prevent this, the line resistance is previously defined based on a maximum transmission distance of the power/signal lines that can be extended from the fire alarm system. Then, a value of a current supplied to the power/signal lines and an upper limit value of the line voltage are limited based on the maximum transmission distance (maximum line resistance).

However, when a current limiting value with respect to the power/signal lines is uniquely limited, the maximum line resistance of the power/signal lines is uniquely limited in turn. On the other hand, a length of the power/signal lines, the number of connected terminal devices, and the like vary depending on an environment in which the fire alarm system is installed, and it is desired to provide a system that can flexibly handle the situations in accordance with an installation location or the like.

SUMMARY OF THE INVENTION

The present invention has been made in order to solve the above-mentioned problem, and an object thereof is to provide a fire alarm system the can maximize a transmission distance in accordance with the scale of the fire alarm system.

According to one embodiment of the present invention, there is provided a fire alarm system, including: a plurality of terminal devices; and a fire control panel connected to the plurality of terminal devices by using a pair of power/signal lines, the fire control panel including: a transmitter/receiver unit for transmitting/receiving a signal based on a pulse voltage to/from the plurality of terminal devices via the pair of power/signal lines; a current value setting unit for setting, as a current limiting value, an upper limit value of a current output to the pair of power/signal lines by the transmitter/receiver unit along with the pulse voltage; and a current control unit for controlling the transmitter/receiver unit to output a current having a value equal to or smaller than the current limiting value set by the current value setting unit.

According to the fire alarm system of one embodiment of the present invention, which includes the current value setting unit for variably setting the current limiting value of the current output to the power/signal lines, it is possible to set a maximum transmission distance in accordance with the scale of the fire alarm system.

DETAILED DESCRIPTION OF THE PREFERRED EMBODIMENTS

Figure 1:
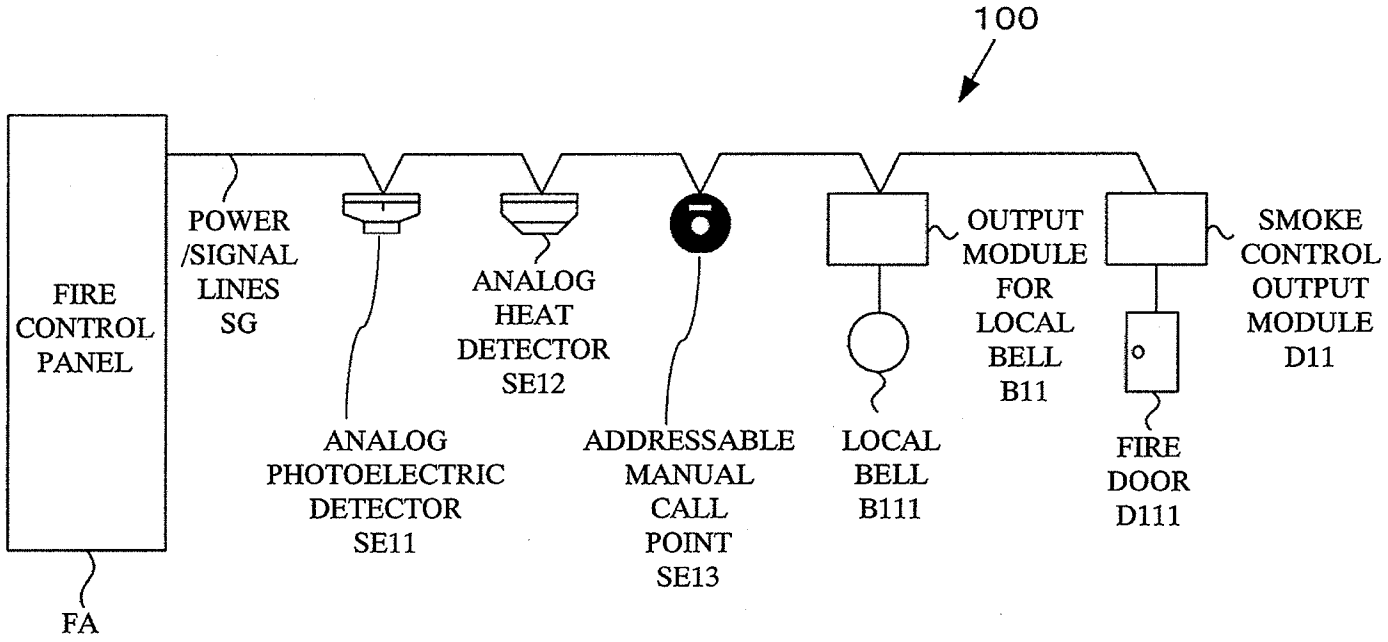
FIG. 1 is a system configuration diagram illustrating a fire alarm system according to a preferred embodiment of the present invention.

Now, a description is made of a fire alarm system according to embodiments of the present invention with reference to the accompanying drawings. FIG. 1 is a system configuration diagram illustrating a fire alarm system according to a preferred embodiment of the present invention. A fire alarm system 100 includes a plurality of terminal devices and a fire control panel FA connected to the plurality of terminal devices via a pair of power/signal lines SG. The fire control panel FA is connected to the plurality of terminal devices such as a fire detector via the power/signal lines SG, and the fire control panel FA and each of the terminal devices communicate to/from each other by, for example, outputting a pulse voltage signal obtained by combining a high-level voltage (VH) and a low-level voltage (VL). Further, a unique address is assigned to each of the terminal devices, and the fire control panel FA can identify each of the terminal devices based on this address.

Examples of the terminal device to be connected to the fire control panel FA include an analog photoelectric detector SE11, an analog heat detector SE12, and an addressable manual call point SE13. The analog photoelectric detector SE11 is one kind of smoke detector, and transmits an analog value corresponding to detected smoke to the fire control panel FA. The analog heat detector SE12 is one kind of heat detector, and transmits an analog value corresponding to a detected ambient temperature to the fire control panel FA. The addressable manual call point SE13 is a so-called fire manual call point, including a push button to be manually operated by a person who discovers a fire. When the push button is turned on, a fire signal is transmitted to the fire control panel FA.

Further, controlled devices are connected to the power/signal lines SG via various output modules being the terminal devices. In FIG. 1, for example, a output module B11 for a local bell is connected to the power/signal lines SG, and the local bell B111 or the like is connected to the output module B11 for the local bell. The local bell B111 outputs sound for issuing an alarm about a fire based on a control signal received from the fire control panel FA. Further, a smoke control output module D11 is connected to the power/signal lines SG, and a fire door D111 or the like serving as a smoke control device is connected to the smoke control output module D11. Those terminal devices connected to the power/signal lines SG are communicated to/from the fire control panel FA via the power/signal lines SG, and are supplied with power via the power/signal lines SG.

The fire control panel FA collects status information on the terminal devices from the respective terminal devices by the following three methods, in other words, point polling, selecting, and system polling, or controls the terminal devices and the like.

(1-1) Point Polling

In order to collect statuses of the plurality of connected terminal devices, the fire control panel FA transmits a status information request command to the terminal devices in groups of several. On the other hand, each of the terminal devices notifies the fire control panel FA of the status information in response to the status information request command at an appropriate timing corresponding to its own address. The fire control panel FA repeatedly communicates to/from the groups in this manner, to thereby collect the status information on all the terminal devices.

(1-2) Selecting

After designating the address corresponding to a desired terminal device, the fire control panel FA transmits a predetermined control command thereto, to thereby control the desired terminal device, or transmits a request command for the status information or the like to a desired terminal device, to thereby collect the status information from each terminal device. The terminal device whose address has been designated notifies the fire control panel FA of a control result in response to the control command, or notifies the fire control panel FA of the requested status information.

(1-3) System polling

The fire control panel FA transmits a common control command to all the terminal devices, to thereby control the respective terminal devices. Examples of the control command issued in the system polling include a fire reset command (command to reset a detector, a output module, or the like that has output the fire signal to a normal supervisory state) and a local sound stop command (command to inactivate the output module B11 for the local bell that is sounding).

(2) Regarding Collection of Information on Status in which Abnormality has Occurred If fire information is included in the status information collected from the terminal devices such as the analog photoelectric detector SE11 in the point polling, the fire control panel FA transmits the control signal in the selecting to the smoke control output module D11 corresponding to the terminal device that has transmitted the fire information based on a terminal database stored in a storage unit 3, to thereby activate a controlled device connected to the output module. Further, when the status information request command is transmitted in the point polling to the terminal device registered in the terminal database stored in the storage unit 3 of the fire control panel FA, if there exists a terminal device that does not respond to the status information request command, a display/operation unit 2 displays that there is no response as described later.

Figure 2:
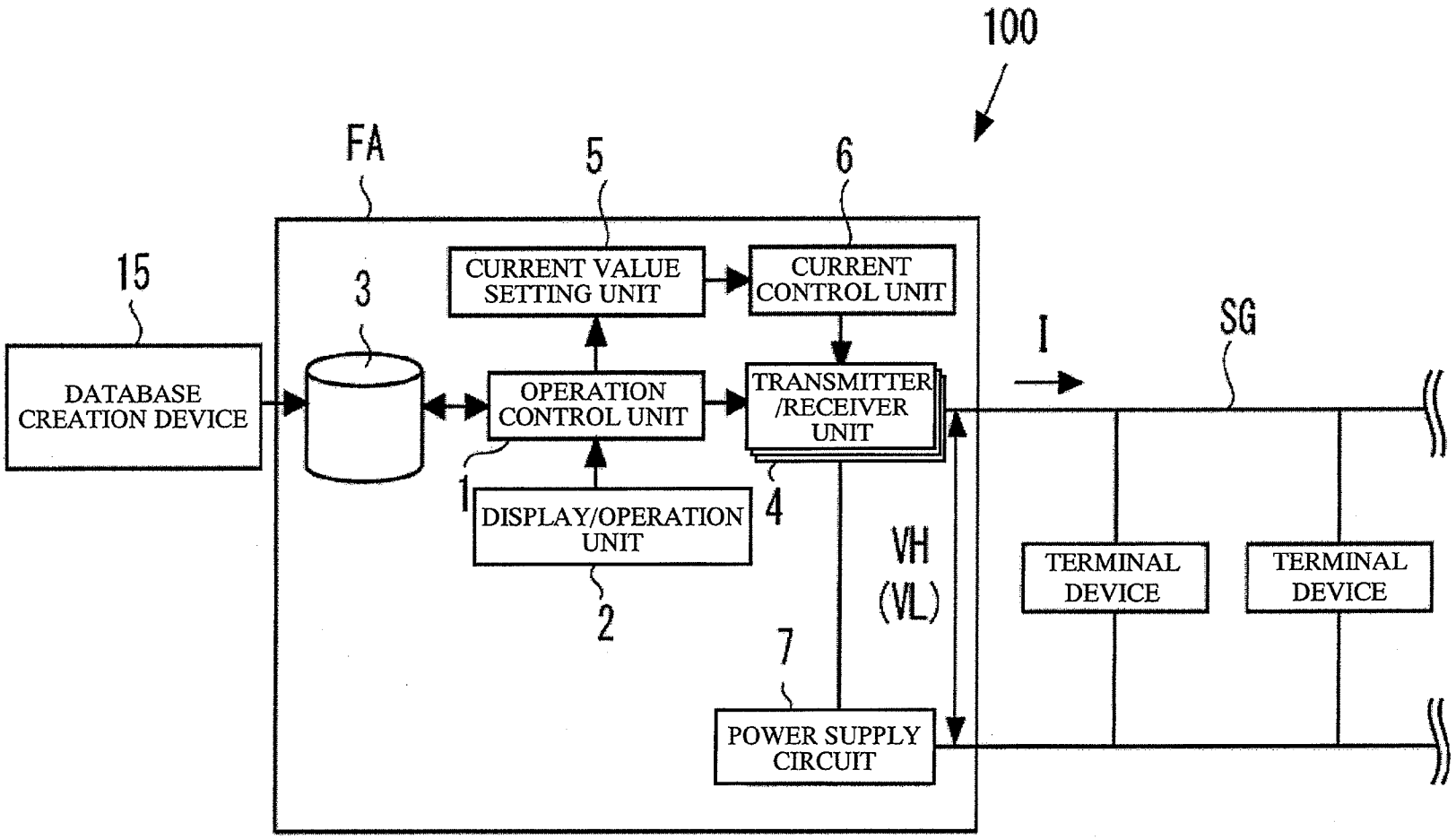
FIG. 2 is a functional block diagram illustrating an example of the fire alarm system illustrated in FIG. 1.

FIG. 2 is a functional block diagram illustrating an example of the fire alarm system 100 illustrated in FIG. 1. The fire control panel FA of the fire alarm system 100 includes an operation control unit 1, the display/operation unit 2, the storage unit 3, a transmitter/receiver unit 4, a current value setting unit 5, and a current control unit 6. The operation control unit 1 controls an operation of the fire control panel FA, and performs each of the above-mentioned kinds of polling on the respective terminal devices via the transmitter/receiver unit 4, to collect the statuses of the respective terminal devices and cause the respective terminal devices to perform various operations such as an examination. The operation control unit 1 has a function of storing the statuses of the respective terminal devices collected by each kind of polling in the storage unit 3.

The display/operation unit 2 is formed of, for example, a touch panel, and has a function as a display unit for displaying various kinds of information, while having a function as an operation unit that allows an operator to touch a screen to select a predetermined switch (command button). Therefore, a predetermined screen is displayed on the display/operation unit 2, while a predetermined selection signal is output to the operation control unit 1 when the operator touches the touch panel. The displaying of the display/operation unit 2 is controlled by the operation control unit 1.

A terminal database DB that stores various kinds of data relating to the terminal devices is stored in the storage unit 3. The terminal database DB allows the data to be registered/updated by an external database creation device 15 formed of a personal computer or the like. The terminal database DB stores the addresses and types of the respective terminal devices connected to the fire control panel FA in association with one another. The address is such a number assigned to each of the terminal devices as to enable identification of the terminal device when the fire control panel FA communicates to/from each of the terminal devices through the transmitter/receiver unit 4 via the power/signal lines SG. The type of the terminal device means a type of each of the terminal device that can directly communicate to/from the fire control panel FA via the power/signal lines SG.

In the terminal database DB, all the terminal devices connected to the transmitter/receiver unit 4 provided to each of a plurality of circuits are registered. Then, the operation control unit 1 controls the terminal devices based on the information in the terminal database DB. Therefore, the number of terminal devices registered in the terminal database DB matches the number of terminal devices connected to the transmitter/receiver unit 4.

The transmitter/receiver unit 4 transmits a pulse voltage (pulse signal) having functions as a signal and a power supply to the respective terminal devices, and receives the signals returned from the terminal devices. The transmitter/receiver unit 4 is controlled by the operation control unit 1. Specifically, the transmitter/receiver unit 4 is electrically connected to a power supply circuit 7, and uses a predetermined voltage supplied from the power supply circuit 7 to output the pulse voltage to the power/signal lines SG. In addition, the transmitter/receiver unit 4 outputs a current when supplying the pulse voltage to the power/signal lines SG. As the current, a current corresponding to a load connected to the power/signal lines SG is caused to flow to be supplied thereto by the pulse voltage applied to the power/signal lines SG.

The current value setting unit 5 sets an upper limit value of the current supplied from the transmitter/receiver unit 4 to the power/signal lines SG as a current limiting value. The current value setting unit 5 has a function of variably setting the current limiting value. Note that, various methods can be used as a method of setting/changing the current limiting value. For example, the current value setting unit 5 is formed of a mechanical change-over switch, and settings of the current limiting value are changed when the operator operates the change-over switch.

Alternatively, a screen for setting the current limiting value may be displayed on the display/operation unit 2, and the current limiting value may be set based on an input performed to the display/operation unit 2 by the operator. The current limiting value set at this time may be input as a numerical value or may be selected by the operator from among a plurality of current limiting values presented on the display/operation unit 2. Further, the current value setting unit 5 may set one current limiting value for a plurality of transmitter/receiver units 4, or may set a different current limiting value for each of the transmitter/receiver units 4.

The current control unit 6 controls the transmitter/receiver unit 4 to supply a current having a value equal to or smaller than the current limiting value set by the current value setting unit 5 to the power/signal lines SG. In other words, the current control unit 6 controls the transmitter/receiver unit 4 to prevent a current having a larger value than the current limiting value from flowing into the power/signal lines SG. For example, the transmitter/receiver unit 4 has a component for changing the current formed of a known part such as a variable resistance, and the current control unit 6 controls the part or the like to supply the current having the value equal to or smaller than the set current limiting value to the power/signal lines SG. In detail, if the current having the value equal to or larger than the current limiting value is caused to flow into the power/signal lines SG when an impedance of the load connected to the power/signal lines SG becomes lower, a voltage output to the power/signal lines SG is lowered so as to prevent further flow of the current.

In this manner, by providing the current value setting unit 5 and the current control unit 6 to variably control the current limiting value for the current supplied to the power/signal lines SG, it is possible to set the current limiting value in accordance with an installation location with a simple operation. That is, in a case where the current limiting value for the current supplied from the transmitter/receiver unit 4 to the power/signal lines SG is fixed, a malfunction may occur in the operation depending on a scale of a system (length of wirings) or the number of terminal devices connected thereto. Specifically, from the viewpoint of transmission of the signal, a high level or a low level may be erroneously determined. Further, from the viewpoint of supply of drive power, power necessary to drive the terminal device may not be supplied.

Figure 3:
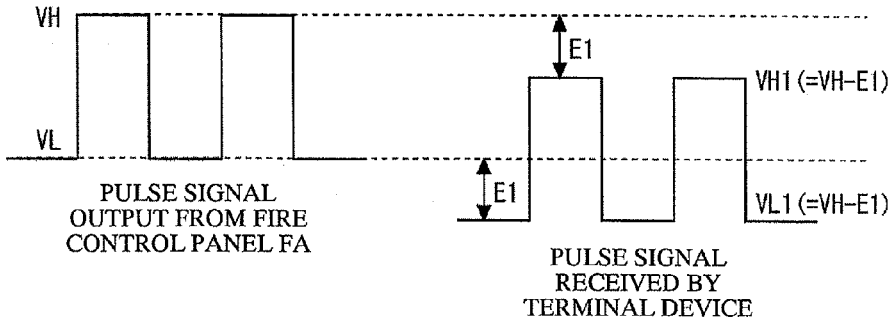
FIG. 3 is a schematic diagram illustrating a pulse voltage transmitted by a fire control panel illustrated in FIG. 1 and the pulse voltage received by a terminal device.

FIG. 3 is a schematic diagram illustrating the pulse voltage transmitted by the fire control panel FA and the pulse voltage received by the terminal device. In FIG. 3, the transmitter/receiver unit 4 transmits the pulse voltage obtained by combining the high-level voltage VH and the low-level voltage VL to the terminal device. In the signal transmitted from the fire control panel FA, the voltage drops by a line voltage E1=R×I based on a line resistance R of the power/signal lines SG and a consumption current I consumed by the terminal device connected to the power/signal lines SG in a normal operation. Note that, the line resistance R is obtained by summing up round-trip wiring resistances between the fire control panel FA and the terminal device. Therefore, the pulse voltage received by the terminal device has a high-level voltage VH1=VH−E1 and a low-level voltage VL1=VL−E1, which are lower than the high-level voltage VH and the low-level voltage VL output from the fire control panel FA by the line voltage E1.

Figure 4:
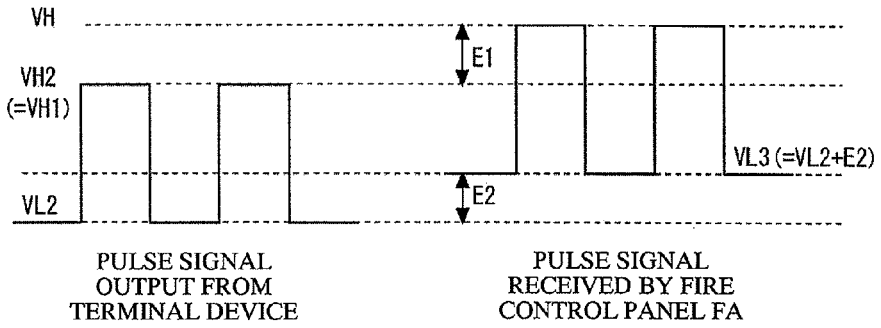
FIG. 4 is a schematic diagram illustrating the pulse voltage returned by the terminal device illustrated in FIG. 1 and the pulse voltage received by the fire control panel.

Next, FIG. 4 is a schematic diagram illustrating the pulse voltage returned by the terminal device and the pulse voltage received by the fire control panel FA. In FIG. 4, the terminal device responds to the signal supplied from the fire control panel FA and returns a pulse voltage. The terminal device returns the pulse voltage obtained by combining a high-level voltage VH2 and a low-level voltage VL2 to the fire control panel FA. At this time, the terminal device outputs the voltage supplied from the fire control panel FA as the high-level voltage VH2 (=VH1=VH−E1) as it is. Therefore, a voltage of the power/signal lines SG is not changed by the terminal device, and hence the fire control panel FA receives the high-level voltage VH, which is supplied to the power/signal lines SG by the fire control panel FA itself, as it is. In detail, the current flowing through the power/signal lines SG remains a consumption current consumed by the terminal device in the normal operation, and the high-level voltage VH2 is lowered by the line voltage E1 from the fire control panel FA to the terminal device, but is received from the terminal device by the fire control panel FA after rising by the line voltage E1. In other words, the fire control panel FA receives VH=VH2+E1.

On the other hand, the terminal device is configured to increase the current value of the current output from the terminal device by using a constant voltage circuit in the terminal device when outputting the low-level voltage VL2. In other words, the terminal device outputs the low-level voltage VL2 by increasing the current value instead of lowering a voltage between a pair of lines of the power/signal lines SG In detail, when the terminal device outputs the low-level voltage VL2, the terminal device causes the constant voltage circuit to flow the current having the current limiting value into the power/signal lines SG When the terminal device causes the current having the current limiting value to flow, in the fire control panel FA, the current control unit 6 controls the voltage output to the power/signal lines SG to drop to the low-level voltage VL2 at the terminal device. This imposes a limitation on the current because only the current below the current limiting value is supplied to the power/signal lines SG by the fire control panel FA.

Here, assuming that a line voltage E2 is applied when the current having the current limiting value is supplied to the power/signal lines SG, the fire control panel FA receives the low-level voltage VL2 output from the terminal device as a low-level voltage VL3=VL2+E2. As described above, due to the wiring resistance from the terminal device to the fire control panel FA, as the current value of the current output from the terminal device becomes larger, in other words, as the current limiting value becomes larger, the line voltage E2 becomes higher, and hence the low-level voltage VL3 received by the fire control panel FA rises.

Even in the fire control panel FA, threshold value processing is used to determine whether or not the low-level voltage VL3 indicates a low-level signal. If the rising line voltage E2 has become so high that the low-level voltage VL3 has a value larger than a threshold value, the terminal device cannot recognize that the low-level voltage VL3 indicates the low-level signal.

In this manner, in the case where the current limiting value is fixed, a malfunction may occur in the operation depending on the scale of the system (length of wirings) or the number of terminal devices connected thereto. Therefore, when the line resistance R increases by increasing the length of the wirings, the current limiting value needs to be lowered in order to keep the rising line voltage E2 at a low level.

At this time, in the current value setting unit 5 of the fire control panel FA illustrated in FIG. 2, the current limiting value for the current supplied from the transmitter/receiver unit 4 to the power/signal lines SG is set to an arbitrary value in accordance with a scale of the fire alarm system 100. This allows a maximum transmission distance to be set in accordance with the scale of the fire alarm system 100. In other words, by providing the current value setting unit 5 for variably setting the current limiting value for the current supplied to the power/signal lines SG, it is possible to set the current limiting value in accordance with the installation location with a simple operation, and hence the maximum transmission distance in accordance with the scale of the fire alarm system 100 can be set.

Specifically, a magnitude of the pulse voltage is set in advance (for example, VH=24 V), and the value of the threshold value used when the threshold value processing is performed for the pulse voltage is already known as well. Therefore, it is possible to previously calculate the value of the rising line voltage E2 at which communications can be performed without causing a malfunction in the threshold value processing. On the other hand, the rising line voltage E2 is proportional to a transmission distance (line resistance R) and the current limiting value, and differs depending on the individual fire alarm system 100. At this time, if the length of the wirings in a facility such as a building in which the fire alarm system 100 is installed is known, it is possible to find the current limiting value that does not cause a malfunction in the communications. Therefore, by customizing the current limiting value for each individual fire alarm system 100 to be set in accordance with the maximum transmission distance, it is possible to prevent a multifunction from occurring in the communications.

Note that, in order to prevent the current having the current limiting value from flowing through the power/signal lines SG in the normal operation, it is necessary to limit the maximum number of terminal devices connected to the power/signal lines SG in accordance with the current limiting value. If the terminal devices are connected to the power/signal lines SG in such a number that the value of the consumption current in the normal operation exceeds the current limiting value, the limitation is constantly imposed on the current, and a low voltage is supplied to the power/signal lines SG, which prevents the terminal devices from operating.

Here, the current limiting value using the current value setting unit 5 is set by the operator through the switching using the change-over switch, an operation using the display/operation unit 2, or the like, but the fire control panel FA may control to automatically limit the number of connectable terminal devices in accordance with the current limiting value. Specifically, FIG. 5 is a flowchart illustrating an operation example of the fire alarm system, and the operation example of the fire alarm system is described with reference to FIG. 1 to FIG. 5.

Figure 5:
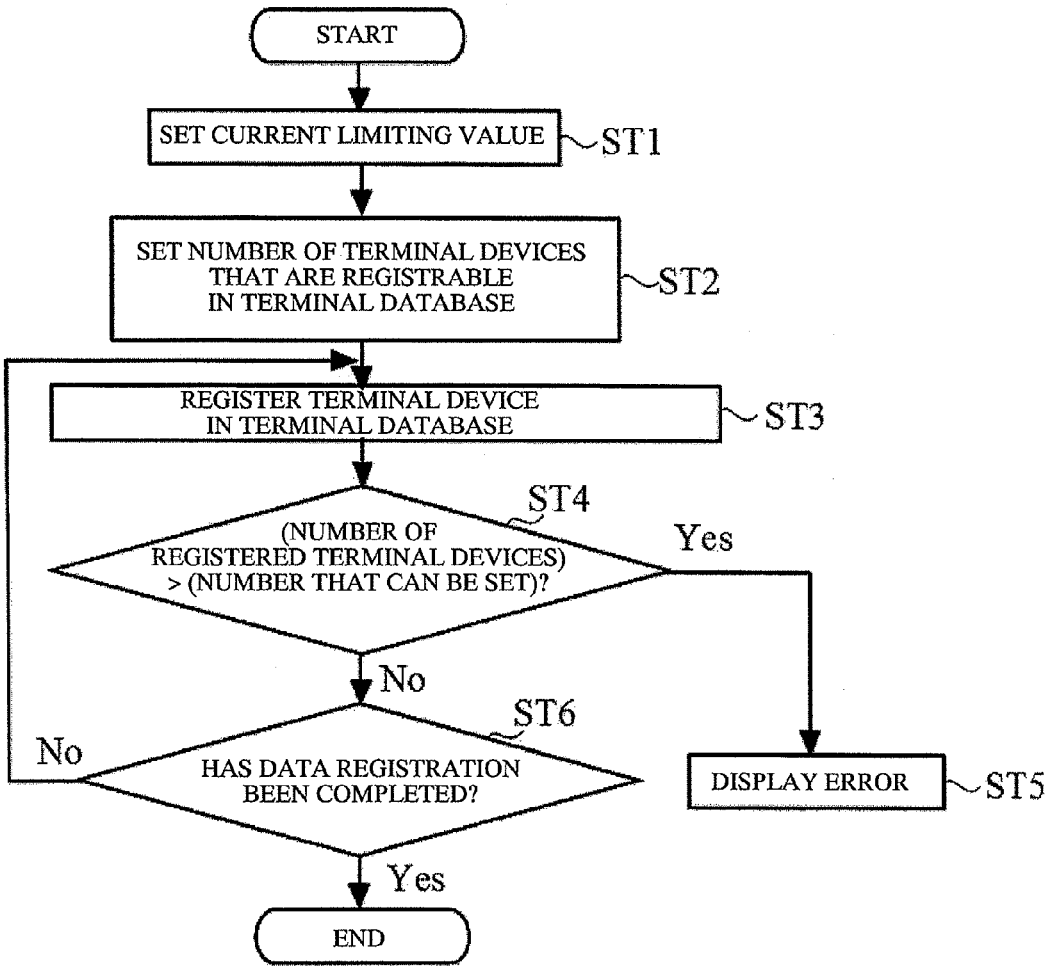
FIG. 5 is a flowchart illustrating an operation example of the fire alarm system illustrated in FIG. 1.

Note that, in a case of performing the following operation as illustrated in FIG. 5, the storage unit 3 stores not only the above-mentioned terminal database DB but also a current value setting table in which a plurality of pieces of current limiting value information are associated with the number of terminal devices that are connectable to the transmitter/receiver unit 4. Further, the operation control unit 1 has a function of controlling the database creation device 15 to register the information on the terminal device in the terminal database DB. Further, the registration of the terminal device is supervised as described below for each of the plurality of transmitter/receiver units 4 (for example, circuit 1 to circuit 12).

First, for example, the operation control unit 1 displays a selection screen for the current limiting value on the display/operation unit 2. The operator selects one current limiting value from among a plurality of current limiting values based on the selection screen. Then, the current value setting unit 5 sets the selected current limiting value, and the current control unit 6 controls the transmitter/receiver unit 4 to supply the power/signal lines SG with the pulse voltage at which the current has a value equal to or smaller than the current limiting value (Step ST1). Subsequently, the operation control unit 1 extracts the number of terminal devices that are connectable to the transmitter/receiver unit 4 from the current value setting table. Then, the operation control unit 1 sets the extracted number of terminal devices as the number of terminal devices that are registrable in the terminal database DB (Step ST2).

When the information on the terminal device is registered in the terminal database DB by the database creation device 15 (Step ST3), the operation control unit 1 determines whether or not the number of terminal devices registered in the terminal database DB is larger than a registrable number (Step ST4). If the number of registered terminal devices is larger than the registrable number, it is determined that an adverse effect may be exerted by the limitation constantly imposed on the current as described above, and an error indicating that the number of registered terminal devices is too large is displayed (Step ST5). The operation control unit 1 supervises the registration so that the number of terminal devices registered in the terminal database DB does not exceed the registrable number until work for registering all the terminal devices in the terminal database DB is completed (Steps ST3 to ST6).

In this manner, by automatically limiting the number of terminal devices that are registrable in the terminal database DB (that are connectable to the power/signal lines SG) in accordance with the current limiting value set in the current value setting unit 5, it is possible to automatically set the current limiting value in accordance with the installation location without having the operator operate the change-over switch or the like.

Note that, FIG. 5 illustrates the example of limiting the number of terminal devices that are registrable in the terminal database DB based on the set current limiting value, but the current limiting value may be automatically set based on the number of terminal devices already registered in the terminal database DB. That is, the current limiting value can be set if the maximum transmission distance is already known and the number of terminal devices is known. Therefore, the current limiting value can be automatically set each time, for example, a terminal device is added or removed.

Specifically, the current value setting unit 5 extracts the number of terminal devices registered in the terminal database DB. Subsequently, the current value setting unit 5 uses the current value setting table to set the current limiting value stored in association with the number of terminal devices. Then, the current control unit 6 controls the transmitter/receiver unit 4 so that so that the current having the value equal to or smaller than the current limiting value set by the current value setting unit 5 is output to the power/signal lines SG.

In this manner, in consideration of the rising line voltage E2, the current limiting value can be automatically changed when, the terminal device is newly registered in the terminal database DB or erased therefrom, and it is possible to set an optimal current limiting value at all times without having the operator operate the change-over switch or the like.

The embodiment of the present invention is not limited to the above-mentioned embodiment. For example, in FIG. 5, instead of displaying the error (Step ST6), a warning for recommending reduction in the number of terminal devices to be registered may be displayed on the display/operation unit 2. In addition, in a case where situations in which the terminal devices are registered are supervised for each of the transmitter/receiver units 4, and the registrable number is exceeded in a predetermined transmitter/receiver unit 4 while the terminal device can be connected in another transmitter/receiver unit 4, advisory information for recommending connection to the another transmitter/receiver unit 4 may be output instead of displaying the error.

Second Embodiment

As another embodiment of the present invention, the current limiting value may be set by the database creation device 15 instead of the display/operation unit 2 or the like of the fire control panel FA. Note that, in the case where the current limiting value is set by the database creation device 15, the current limiting value information is stored in addition to the above-mentioned terminal database in the storage unit 3 of the fire control panel FA.

Figure 6:
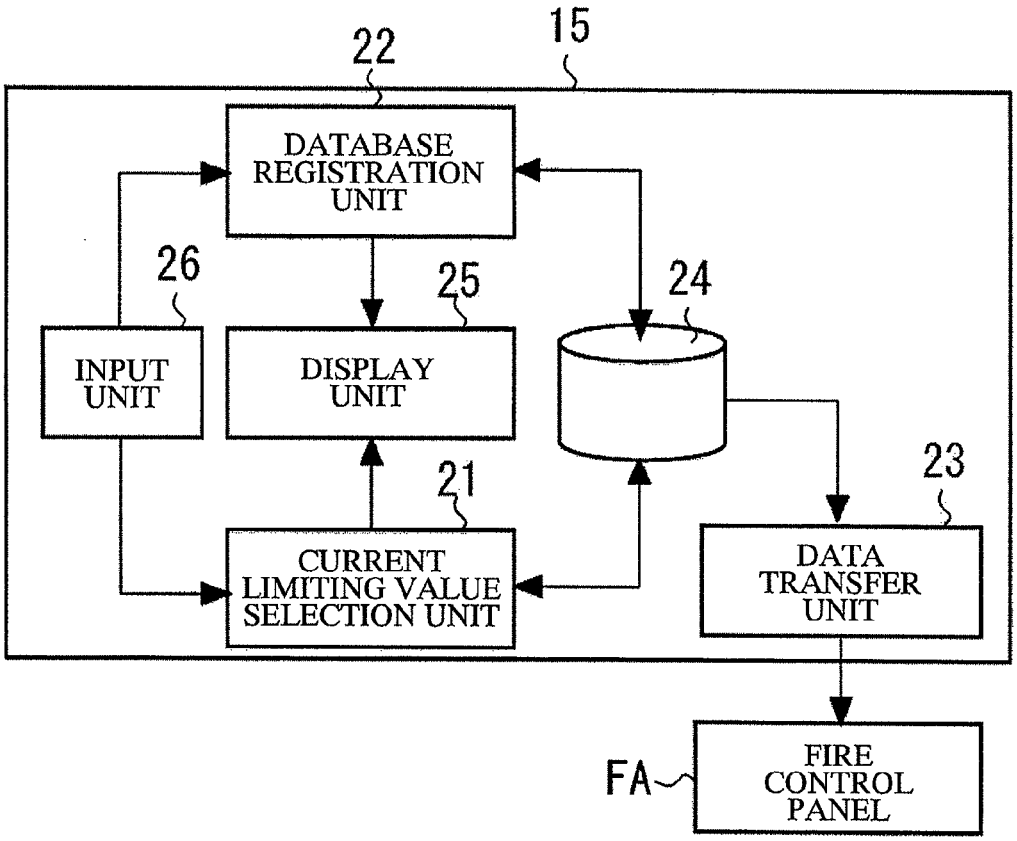
FIG. 6 is a functional block diagram illustrating an example of a database creation device illustrated in FIG. 1.

As illustrated in FIG. 6, the database creation device 15 includes a current limiting value selection unit 21, a database registration unit 22, and a data transfer unit 23. Note that, the operation control unit 1 has a function of controlling the registration of the terminal database DB and the current limiting value information performed by the database creation device 15.

The current limiting value selection unit 21 selects the current limiting value set by the current value setting unit 5 of the fire control panel FA. Specifically, the current limiting value selection unit 21 stores a current value information setting table in which the plurality of pieces of current limiting value information and the number of terminal devices that are connectable to the transmitter/receiver unit 4 of the fire control panel FA are stored in association with each other. Then, for example, the current limiting value selection unit 21 displays a selection screen for the current limiting value information on a display unit 25. The operator selects one piece of the current limiting value information from among the plurality of pieces of current limiting value information based on the selection screen. Then, the current limiting value information selected by the current limiting value selection unit 21 is saved in a registered data storage unit 24 as information to be transferred to the fire control panel FA.

The database registration unit 22 sets the number of terminal devices that are registrable based on the current limiting value selected by the current limiting value selection unit 21, and creates the terminal database by receiving the registration of the terminal devices with the set number as an upper limit thereof. Specifically, the database registration unit 22 extracts the number of terminal devices that are connectable to the transmitter/receiver unit 4 of the fire control panel FA from the current value information setting table based on the current limiting value information selected by the current limiting value selection unit 21. Then, the database registration unit 22 displays a terminal database DB setting screen 30 illustrated in FIG. 7, which assumes the extracted number of terminal devices as a maximum number of addresses, on the display unit 25.

Figure 7:
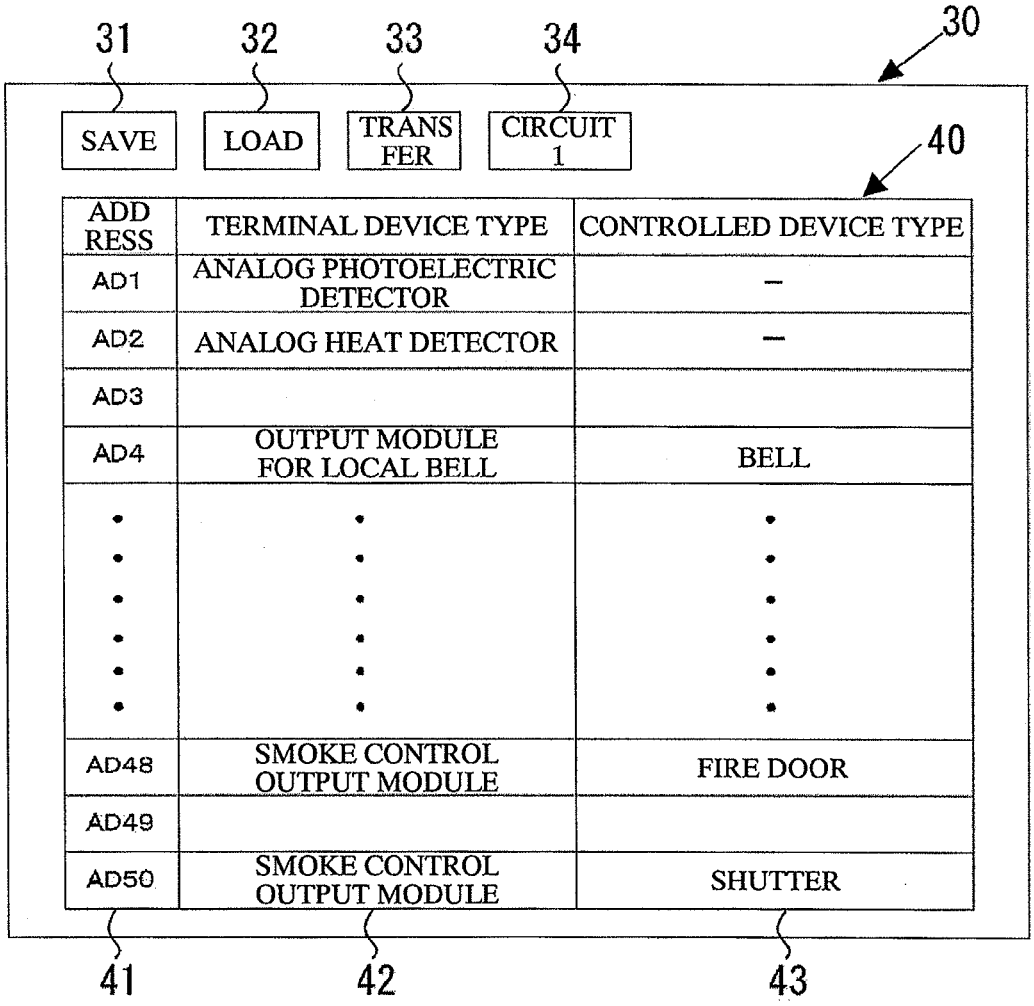
FIG. 7 is a schematic diagram illustrating an example of a screen displayed on a display unit by a database registration unit of the database creation device illustrated in FIG. 6.

Now, a description is made of the terminal database DB setting screen 30 illustrated in FIG. 7. The terminal database DB setting screen 30 includes a save button 31, a load button 32, a transfer button 33, a circuit selection button 34, and a database setting table 40. Further, the database setting table 40 includes, from the left side, an address number display column 41, a terminal device type setting column 42, and a controlled device setting column 43. The address number display column 41 has an address number AD1 to the largest address (in the example of FIG. 7, (maximum number of addresses)=50) displayed therein in a registrable state. The terminal device type setting column 42 and the controlled device setting column 43 allow the registration of the terminal device corresponding to each address number by, for example, a pull-down menu. When the operator presses the transfer button 33 after the registration is completed, the data transfer unit 23 illustrated in FIG. 6 transfers the terminal database DB registered by the database registration unit 22 to the fire control panel FA. Then, the information on the current limiting value and the terminal device selected by the database creation device 15 is stored in the storage unit 3 of the fire control panel FA illustrated in FIG. 1. At this time, the current value setting unit 5 reads the current limiting value stored in the storage unit 3, and sends the current limiting value to the current control unit 6.

In this manner, the information on the current limiting value and the terminal device is previously set by the database creation device 15, to thereby eliminate the need to perform registration work at the installation location or the like in actuality, and hence the current limiting value or the like can be efficiently set.

Further, the current limiting value is set by the database creation device 15, and the terminal device is set based on the set current limiting value, and hence the terminal devices are prevented from being set in a number that exceeds the number corresponding to the current limiting value, and it is possible to efficiently set the database of the terminal devices.

What is claimed is:

1. A fire alarm system, comprising:

a fire control panel; and a plurality of terminal devices connected to the fire control panel by using a pair of power and signal lines, and communicated with the fire control panel via the power and signal lines, the fire control panel comprising:

a transmitter and receiver unit for transmitting and receiving a signal based on a pulse voltage to and from the plurality of terminal devices via the pair of power and signal lines;

a current value setting unit for setting, as a current limiting value, an upper limit value of a current output to the pair of power and signal lines by the transmitter and receiver unit along with the pulse voltage;

a current control unit for controlling the transmitter and receiver unit to output a current having a value equal to or smaller than the current limiting value set by the current value setting unit; and a storage unit for storing:

a current value setting table in which a plurality of pieces of current limiting value information and a number of the plurality of terminal devices that are connectable to the transmitter and receiver unit are stored in association with each other; and a terminal database for registering information on the plurality of terminal devices connected to the transmitter and receiver unit; and an operation control unit for controlling registration of the information on the plurality of terminal devices in the terminal database, wherein the operation control unit extracts the number of the plurality of terminal devices that are connectable to the transmitter and receiver unit from the current value setting table when the current limiting value is set by the current value setting unit, and sets the extracted number of the plurality of terminal devices as the number of the plurality of terminal devices that are registrable in the terminal database.

2. A fire alarm system according to claim 1, further comprising a database creation device for registering information on the plurality of terminal devices in the terminal database, wherein the database creation device comprises:

a current limiting value selection unit for selecting the current limiting value set by the current value setting unit of the fire control panel;

a database registration unit for setting a number of the plurality of terminal devices that are registrable based on the current limiting value selected by the current limiting value selection unit, and creating a terminal database by receiving registration of the plurality of terminal devices with the set number of the plurality of terminal devices as an upper limit thereof; and a data transfer unit for transferring the terminal database registered by the database registration unit to the fire control panel.

3. A fire alarm system, comprising:

a fire control panel; and a plurality of terminal devices connected to the fire control panel by using a pair of power and signal lines, and communicated with the fire control panel via the power and signal lines, the fire control panel comprising:

a transmitter and receiver unit for transmitting and receiving a signal based on a pulse voltage to and from the plurality of terminal devices via the pair of power and signal lines;

a current value setting unit for setting, as a current limiting value, an upper limit value of a current output to the pair of power and signal lines by the transmitter and receiver unit along with the pulse voltage; and a current control unit for controlling the transmitter and receiver unit to output a current having a value equal to or smaller than the current limiting value set by the current value setting unit; and a storage unit for storing:

a current value setting table in which a plurality of pieces of current limiting value information and a number of the plurality of terminal devices that are connectable to the transmitter and receiver unit are stored in association with each other; and a terminal database for registering information on the plurality of terminal devices connected to the transmitter and receiver unit, wherein the current value setting unit extracts the number of the plurality of terminal devices registered in the terminal database, and sets the current limiting value by using the extracted number of the plurality of terminal devices and the current value setting table.

4. A fire alarm system according to claim 3, further comprising a database creation device for registering information on the plurality of terminal devices in the terminal database, wherein the database creation device comprises:

a current limiting value selection unit for selecting the current limiting value set by the current value setting unit of the fire control panel;

a database registration unit for setting a number of the plurality of terminal devices that are registrable based on the current limiting value selected by the current limiting value selection unit, and creating a terminal database by receiving registration of the plurality of terminal devices with the set number of the plurality of terminal devices as an upper limit thereof; and a data transfer unit for transferring the terminal database registered by the database registration unit to the fire control panel.

* * * * *